US005403016A

United States Patent [19]

Kudo

[11] Patent Number: 5,403,016

[45] Date of Patent: Apr. 4, 1995

[54] CHIP FLIPPING GAME

[76] Inventor: Kenneth M. Kudo, Post Office Box 1214, Pahoa, Hi. 96778

[21] Appl. No.: 138,427

[22] Filed: Oct. 20, 1993

[51] Int. Cl.[6] ..... A63B 67/12

[52] U.S. Cl. ..... 273/353; 273/424

[58] Field of Search ..... 273/353, 424, 317

[56] References Cited

U.S. PATENT DOCUMENTS 1,864,500 6/1932 Linngston et al. ..... 273/353 X 3,784,200 1/1974 Hotchkiss ..... 273/424 X 4,325,556 4/1982 Decanto et al. ..... 273/424 X

*Primary Examiner*—William H. Grieb

*Attorney, Agent, or Firm*—Michael I. Kroll

[57] ABSTRACT

A chip flipping game is provided which consists of a plurality of chips that are disk shaped having indicia printed on one side. Each player plays against a Dealer by stacking their chips with a matching amount of chips from the Dealer and tries to flip them over by striking the chips with one chip held between the fingers, so as to win chips which are flipped over from the stacked chips.

1 Claim, 1 Drawing Sheet

CHIP FLIPPING GAME

BACKGROUND OF THE INVENTION

1. Field of the Invention

The instant invention relates generally to gaming devices and more specifically it relates to a chip flipping game.

2. Description of the Prior Art

Numerous gaming devices have been provided in prior art that are adapted to be competitive games played upon game boards. While these units may be suitable for the particular purpose to which they address, they would not be as suitable for the purposes of the present invention as heretofore described.

SUMMARY OF THE INVENTION

A primary object of the present invention is to provide a chip flipping game that will overcome the shortcomings of the prior art devices.

Another object is to provide a chip flipping game in which chips printed on one side are used with a playing board, whereby each player plays against a Dealer.

An additional object is to provide a chip flipping game in which the playing board is placed upon a table, so that each player will stack their chips with a matching amount of the Dealer chips and try to flip them over by striking the chips with one chip, so as to win chips from the Dealer, while also placing separate side bets.

A further object is to provide a chip flipping game that is simple and easy to use.

A still further object is to provide a chip flipping game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
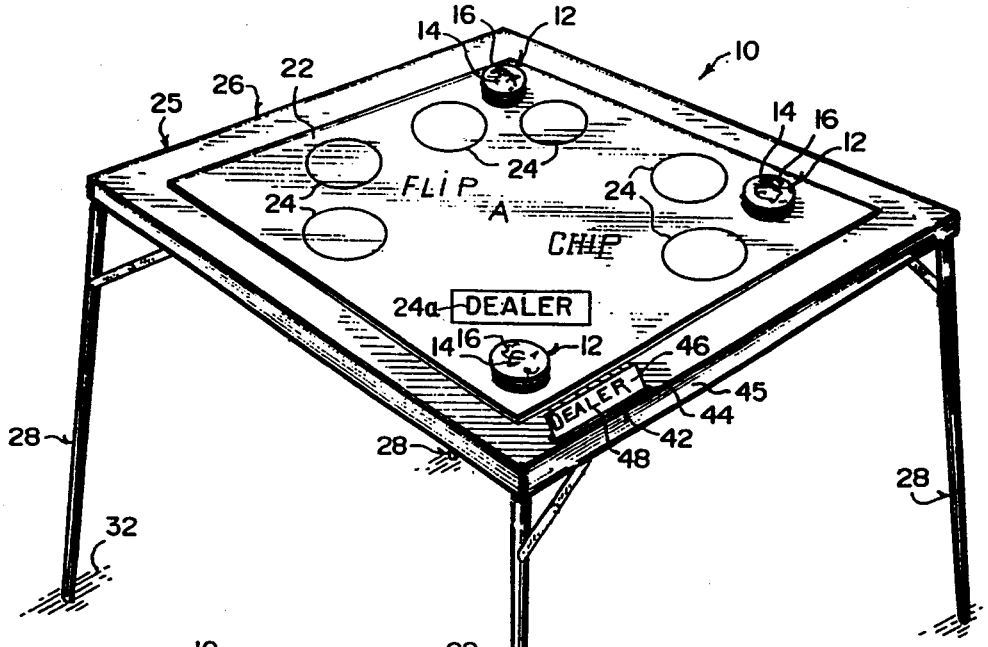
FIG. 1 is a perspective view of the instant invention.
Figure 2:
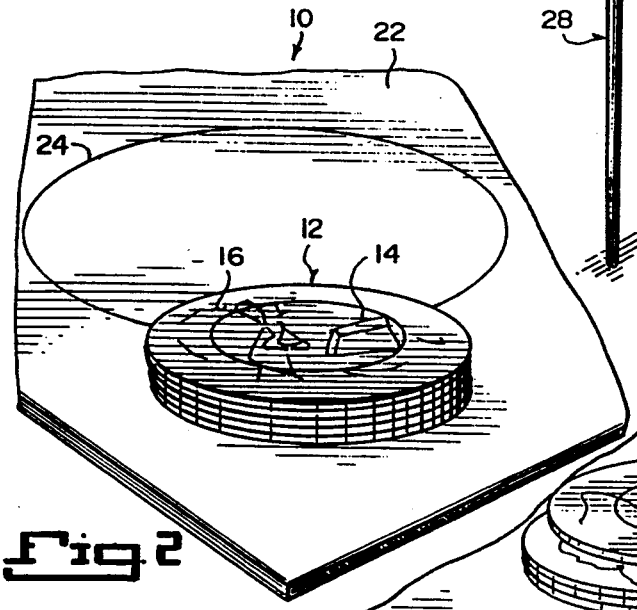
FIG. 2 is an enlarged perspective view of a corner portion of the playing board and a stack of chips thereon.
Figure 3:
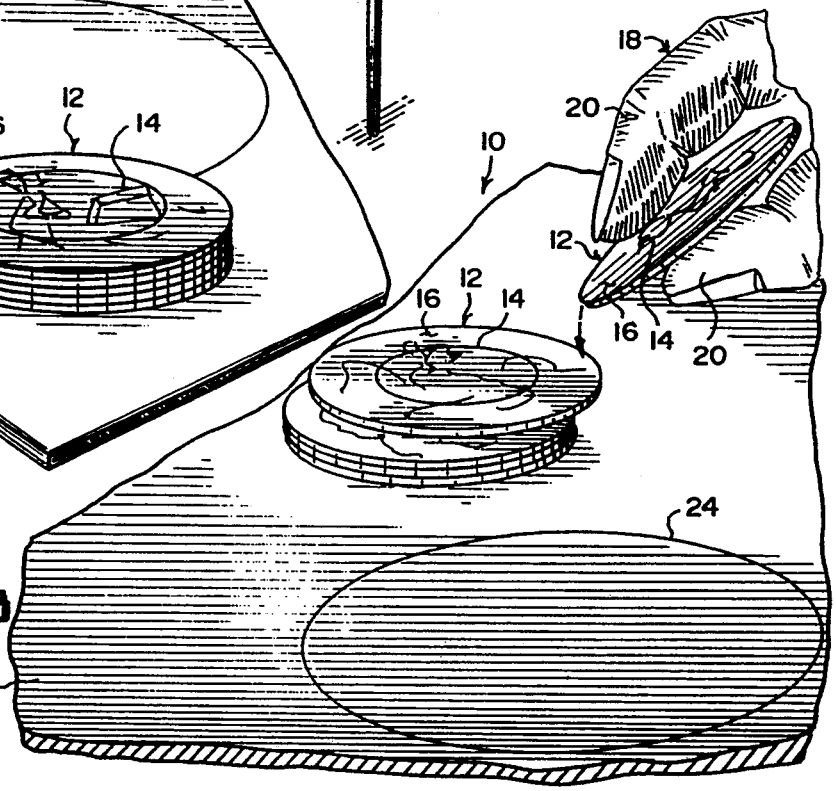
FIG. 3 is an enlarged perspective view of a portion of the playing board, showing one of the stack of chips ready to be flipped by a chip held in the fingers of one of the players.

Turning now descriptively to the drawings, in which similar reference characters denote similar elements throughout the several views, FIGS. 1 through 3 illustrate a chip flipping game 10 which consists of a plurality of chips 12 that are disk shaped having indicia 14 printed on one side 16. Each player 18 plays against a Dealer by stacking their chips 12 with a matching amount of chips from the Dealer and tries to flip them over by striking the chips 12 with one chip 12 held between the fingers 20, so as to win the chips 12 which are flipped over from the stacked chips 12.

Each player 18 can also play against the Dealer by side betting on the player who's turn it is, by placing a separate bet with the chips 12, prior to each players turn. The player 18 will win a matching amount of the dealers chips if all the chips 12 in an entire stack gets flipped over. The player 18 will lose if all the chips 12 do not get flipped over.

A playing board 22 is also provided, so that all the players 18 can stack their chips 12 upon the playing board 22, when playing the game 10 against the Dealer. The playing board 22 includes a plurality of paired circles 24 printed thereon, in which one set of paired circles 24 represents one player 18. One circle 24 is for stacking and whacking, while the other circle 24 is for separate side betting.

The playing board 22 can include the word "DEALER" *24a* printed thereon, to indicate to all the players 18, where the Dealer is located at the playing board 22.

As shown in FIG. 1, the chip flipping game 10 also contains a playing table 25. The playing board 22 can be placed upon the playing table 25. The players 18 and Dealer can be located about the playing table 25 when playing the game 10.

The playing table 25 includes a table top 26, slightly larger than the playing board 22. A pedestal or legs 28 extend downwardly from the table top 26, so as to elevate the table top 26 above the floor 32. The players 18 and the Dealer may sit or stand at the playing table 25 while playing.

A stand 42, shown in FIG. 1, indicates to all the players 18 where the Dealer is located at the playing table 25. The stand 42 contains a base rack 44 to be placed near one edge 45 of the table top 26. A sign plate 46 is held on the base rack 44, while the word "DEALER" 48 is printed on the sign plate 46.

Each chip 12 ranges from approximately one and one eighth of an inch to one and seven eights of an inch in diameter. Each chip 12 also ranges from approximately three hundreds of an inch (0.30) to seven hundreds of an inch (0.070) in thickness. Each chip 12 is fabricated out of a durable strong material, such as cardboard and plastic.

RULES OF THE GAME

To play the game the following rules should be followed:

1. The object of the game is for each player 18 to win chips 12 from the Dealer by (A) flipping them over and by (B) effective side betting on each others ability.
2. The Dealer faces one or more players across the playing table 24.
3. The Dealer announces the betting limit.
4. Betting—Each player 18 places on the playing board 22 in front of him the number of chips 12 he wishes to bet, but not more than the limit.
5. The Dealer is then obliged to match the bet by placing the equal amount of chips 12 in front of each player 18.
6. Stacking—Each player 18 stacks the chips 12 in front of him one on top of the other with the indicia 14 on the side 16 up.
7. Whacking—Each player 18 one at a time, starting from left to right, strikes their stack of chips 12 one time only, using a single chip 12 held with the fingers 20 in an attempt to flip over as many chips 12 as possible.
8. Only the single chip 12 may contact the stack of chips 12.

9. It is a foul if any part of the hand or body makes contact with the stacked chips 12.

10. After striking the stack of chips 12, and before the next players turn the player 18 collects from the table the chips 12 which have been flipped over.

11. The Dealer collects from the table any and all of the remaining chips not flipped over.

12. The game 10 goes on by repeating again and again the rules 4 through 11.

13. The game 10 ends when the Dealer or players 18 decide to stop, or when either the Dealer or players 18 lose all their chips 12.

14. Prior to whacking as indicted in rule 7, all players may side bet on the player who is up (whose turn it is) by placing the number of chips 12 he wishes to side bet on the table in front of him as a separate bet.

15. This is an all over bet. All chips 12 must be flipped over (none remaining unflipped) to win the side bet.

16. After a player 18 strikes the stack, the Dealer collects all side bets if the stack of chips 12 are not flipped all over.

17. The Dealer pays all side bets if the stack of chips 12 are flipped all over (none remaining unflipped).

LIST OF REFERENCE NUMBERS

10 chip flipping game
12 chip
4 indicia
16 one side of 12
18 player
20 finger of 18
22 playing board
24 circle on 22
**24*a* word "DEALER" on 22**
25 playing table
26 table top of 25
28 pedestal or leg of 25
32 floor
42 stand
44 base rack
45 edge of 26
46 sign plate
48 word "DEALER" on 46

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A chip flipping game having a method of playing comprising the steps:

a) having a dealer face one or more players across a playing table;

b) announcing a betting limit by said dealer;

c) placing a wager by said players on a playing board directly in front of said player, said wager being a number of chips he/she wishes to bet but not exceeding said betting limit;

d) matching said player's bet by said dealer by playing on equal number of chips on front of each of said players;

e) stacking said chips by said players in front of said player with a side of said chip exhibiting indicia on top;

f) whacking of said stacked chips by said player, commencing in a clockwise direction, from left to right for each player's turn, by each of said players holding a single chip with said player's fingers, flipping said single chip, striking said player's stacked chips, one time only, attempting to flip over as many chips as possible without touching said stacked chips with said person's body part causing a foul prior to whacking, any and all players may wager side bets on player whose turn is up by placing a number of chips he/she wishes to bet on said table in front of said player being a separate bet but all chips must be flipped over with none remaining unflipped for a player to win said side bet;

g) collecting said fallen chips by said player prior to a next player's turn;

h) collecting from said table by said dealer any and all remaining chips not flipped over and fallen;

i) repeating again said steps a) through h) until any one or more player loses all of said player chips;

j) repeating again said steps a) through h) until said loses all of said dealer's chips;

k) collecting all side bets by said dealer if said player's stack of cards is not flipped over; and l) paying all side bets by said dealer if said player's stacked chips are all flipped over.

* * * * *